US005357264A

United States Patent [19]

Itoh et al.

[11] Patent Number: 5,357,264

[45] Date of Patent: Oct. 18, 1994

[54] DISPLAY CONTROLLER FOR DOT MATRIX DISPLAY

[75] Inventors: Hiromichi Itoh, Yokohama; Shigenobu Ishimoto, Chigasaki; Yoshihiro Hayashi, Narashino; Susumu Onodera, Yokohama, all of Japan

[73] Assignees: Hitachi, Ltd.; Hitachi Video & Information System, Inc., both of Tokyo, Japan

[21] Appl. No.: 869,173

[22] Filed: Apr. 16, 1992

[30] Foreign Application Priority Data

Apr. 18, 1991 [JP] Japan ..... 3-086444

[51] Int. Cl.[5] ..... G09G 3/00

[52] U.S. Cl. ..... 345/112; 345/127; 345/168

[58] Field of Search ..... 340/731, 735, 711, 799, 340/750; 382/44, 45, 47; 345/127, 128, 129, 130, 131, 141, 143, 144, 192, 193, 194, 195, 168

[56] References Cited

U.S. PATENT DOCUMENTS 4,875,036 10/1989 Washizuka et al. ..... 340/712
4,935,731 6/1990 Takebe et al. ..... 340/731
5,068,651 11/1991 Takebe et al. ..... 340/731

*Primary Examiner*—Ulysses Weldon
*Assistant Examiner*—Xiao M. Wu
*Attorney, Agent, or Firm*—Antonelli, Terry, Stout & Kraus

[57] ABSTRACT

When display data having a smaller vertical number of pixels than a vertical number of pixels of a display is to be displayed, a display status can be switched during the execution of any application software. When a display selection switch receives a switch command, it outputs a selection signal directly to a display controller, an address generator in the display controller selects one of display modes to the display in accordance with the selection signal. When the display data having the smaller vertical number of pixels than the vertical number of pixels of the display is to be displayed, a user can freely select the display mode without interruption of a CPU during the execution of any application software.

8 Claims, 10 Drawing Sheets

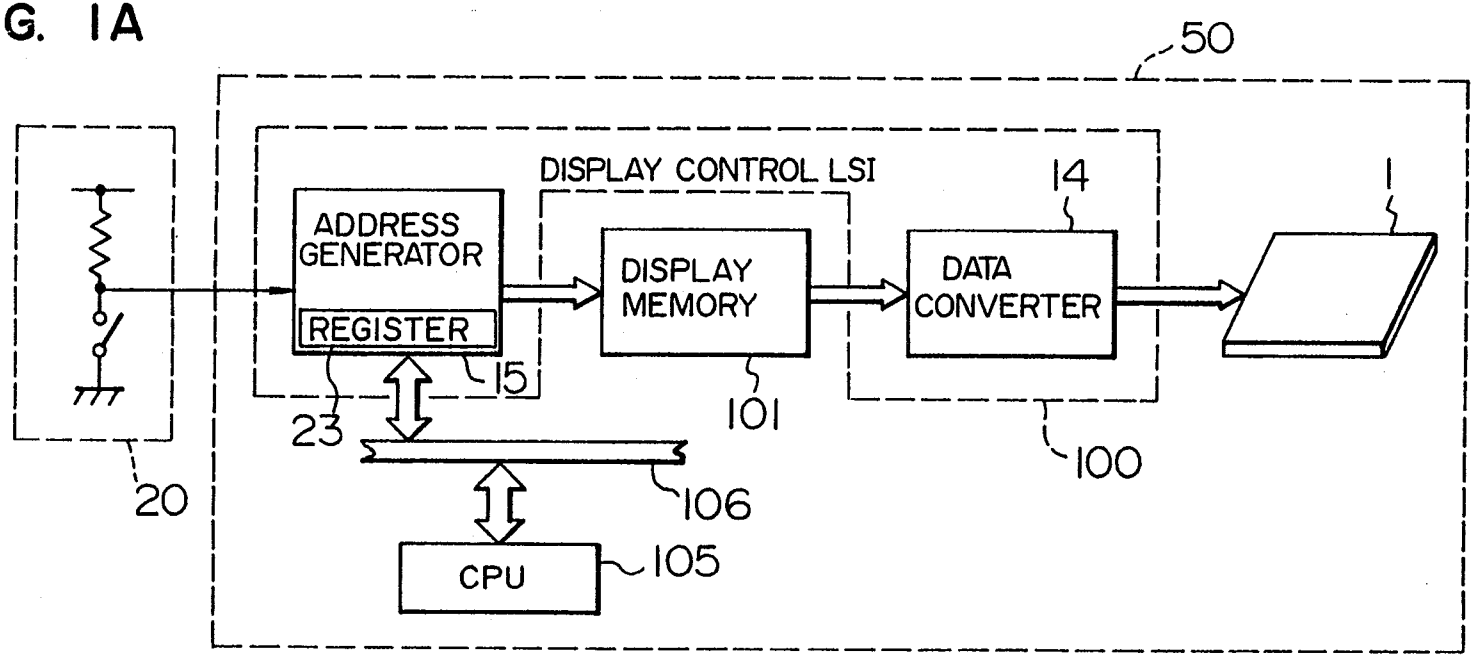
FIG. 1A
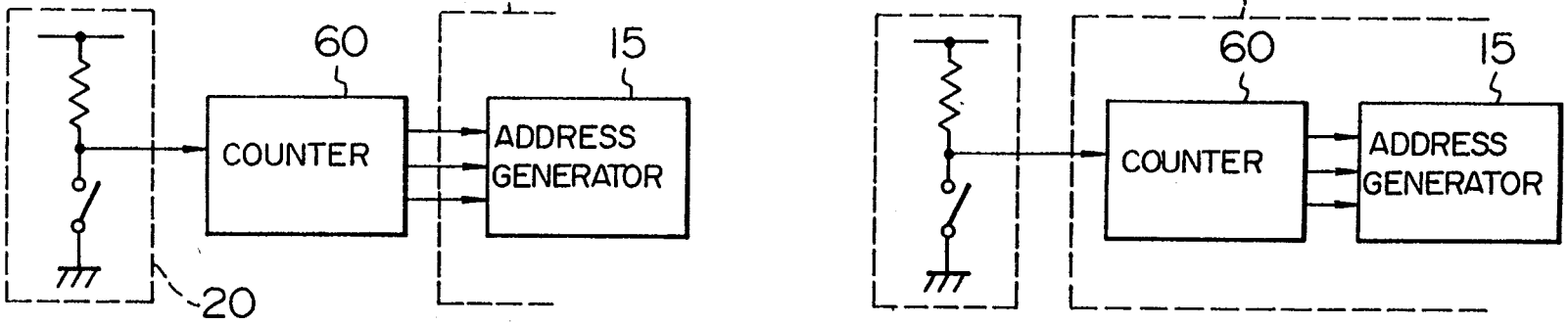
FIG. 1C
FIG. 1B

DISPLAY CONTROLLER FOR DOT MATRIX DISPLAY

BACKGROUND OF THE INVENTION

The present invention relates to a display controller suitable to a display of an information processing system, and more particularly to a display controller to be used when a representation of a certain number of pixels is to be displayed on a display which can display a representation of a larger number of pixels.

Demand for portable personal computers such as notebook-type personal computers and laptop-type personal computers having flat panel displays has been increasing to exceed that for desktop-type personal computers because they are easy to carry and can be battery-powered.

Recent trend is the increase of the number of pixels for display in order to display more information on one screen, and demand for a flat panel display having a large number of pixels has been increasing.

As a result, a display controller which enables a display having a fixed large number of pixels to also display a smaller number of pixels required by existing application software has been required, and various techniques therefor have been proposed.

For example, in a display disclosed in JP-A-1-98793, a start of display position is stored in an internal register of a display controller as an offset value so that information is displayed at a center of the display screen. For example, as shown in FIG. 4, when a vertical number 2 of pixels of the display 1 is 480 dots and a vertical member 3 of pixels required by an existing application software is 400 dots, the offset value 4 for the start of display position is set to "40" to start the display from the start of display position 5 so that the information is displayed at the center of the display screen.

In a display disclosed in JP-A-59-61874, the same information is continuously displayed at every given number of lines so that the information is additionally displayed by the increased number of pixels. For example, as shown in FIG. 5, when the vertical number 2 of pixels of the display 1 and the vertical number 3 of pixels required by the existing application software are 480 dots and 400 dots, respectively, as they are in the above-mentioned center display system, the same data is displayed in two lines every five lines so that the display area is expanded to the entire display area of the display 1.

In order to switch among a plurality of display modes including the two display modes described above, the prior art system uses the content of an I/O register which a central processing unit (CPU) sets by software. This is explained below with reference to the drawing.

FIG. 3 shows a prior art information processing system having a function of switching among a plurality of display modes including the screen center display mode and the incremental pixel supplement display mode described above.

Numeral 1 denotes a dot matrix display, numeral 100 denotes a display control LSI for controlling the display, numeral 101 denotes a display memory for storing display data, numeral 15 denotes an address generator for generating a read address when the display data stored in the display memory 101 is displayed, numeral 14 denotes a data converter for converting the read display data while interfacing it with the dot matrix display 1, numeral 102 denotes a display switching register in which a value corresponding to the display mode to be selected from the plurality of display modes including the two display modes described above are set, numeral 104 denotes a keyboard, numeral 103 denotes a keyboard controller for controlling the keyboard 104, and numeral 105 denotes a CPU for processing application software and display control software.

In order to select one of the plurality of display modes including the screen center display mode and the incremental pixel supplement display mode described above, an operator depresses a specified key of the keyboard 104 to designate a desired display mode. When the specified key is depressed, the keyboard controller 103 issues an interrupt request to the CPU 105, which sets a value corresponding to the designated display mode in the display switching register 102 in an interruption processing routine. The address generator 15 generates a read address to be supplied to the display memory 101 so that the display mode corresponding to the value set in the display switching register 102 is selected.

When a representation of a small number of pixels required by the conventional application software is to be displayed on a display which is capable of displaying with a larger number of pixels, it is preferable for the operator to determine a desired one of the plurality of display modes including the screen center display mode and the incremental pixel supplement display mode while the operator watches the screen of the application software.

However, depending on the application software, the interruption may be inhibited or a keyboard processing routine is governed by the application software and any key entry which the application software does not use may be ignored.

In such a case, the prior art interruption processing system cannot switch the display mode during the execution of the application software.

SUMMARY OF THE INVENTION

It is an object of the present invention to provide a display controller which can switch a display mode during the execution of any application software.

In order to achieve the above object, the present invention provides an information processing system comprising a display controller including address generation means for generating a read address for a display memory which stores display data, to select one of a plurality of display modes for displaying data of a smaller vertical number of pixels than a vertical number of pixels of a display, and signal generation means for receiving a signal for designating a desired one of the display modes, generating a signal corresponding to the received display mode and outputting it directly to the display controller. The address generation means in the display controller generates a read address corresponding to the display mode designated by the input signal.

The signal generation means may be a switch which may be directly connected to the display controller through a signal line. For example, when the switch is of ON/OFF type, two display modes are associated with the ON and OFF states, respectively, so that a signal corresponding to one display mode is generated when the switch is in the ON state and a signal corresponding to the other display mode is generated when the switch is in the OFF state. In this manner, the two display modes may be switched. Alternatively, signals corresponding to a plurality of display modes may be sequentially generated each time the switch is turned on so that more than two display modes are switched.

In the present invention, a content of an internal register of the display controller which relates to the switching of the display mode may be externally set by an operator or internally set or read out by a CPU which executes the application software.

The signal generation means may include a specified key on the keyboard and a keyboard controller which generates an output signal representing a key entry, and the output signal from the keyboard controller may be directly applied to the display controller through a signal line. Alternatively, signals corresponding to a plurality of display modes may be sequentially generated each time the specified key is depressed so that more than two display modes are switched.

Thus, the operator can command the switching of the display mode by depressing the switch or the specified key.

The signal generated by the signal generation means is directly applied to the display controller without routing the CPU which executes the application software. Namely, the switch or the keyboard controller is directly connected to the display controller and the generated signal is directly applied to the display controller. Accordingly, the CPU interruption required in the prior art system is not necessary.

Thus, the operator can freely switch the display mode during the execution of any application software.

The display modes may include the incremental pixel supplement display mode described above, a modified incremental pixel supplement display mode in which the incremental pixel supplement is done between characters to expand a line length, the screen center display mode described above and a modified screen center display mode in which data is displayed at an upper or lower area of the screen.

BRIEF DESCRIPTION OF THE DRAWINGS

FIGS. 1A, 1B and 1C show block diagrams of configurations of one embodiment;

DESCRIPTION OF THE PREFERRED EMBODIMENTS

One embodiment of the present invention is now explained with reference to the drawings, in which the like elements or signals are designated by the same numerals.

FIG. 1 shows a block diagram of a first configuration of the present embodiment.

Numeral 20 denotes a display selection switch 20 for designating a desired one of the screen center display mode and the incremental pixel supplement display mode when a representation of a small number of pixels required in an existing application software is to be displayed on a dot matrix display 1 which can display a representation of a larger number of pixels.

Figure 10A:
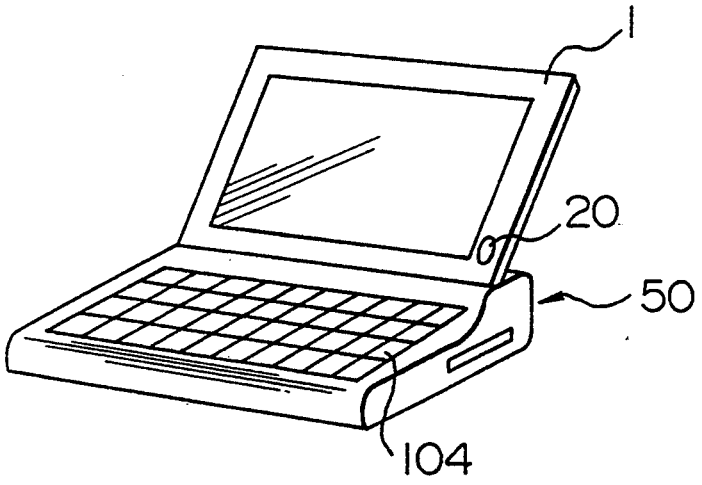
FIGS. 10A and 10B show external views of the embodiment of FIG. 1.
Figure 10B:
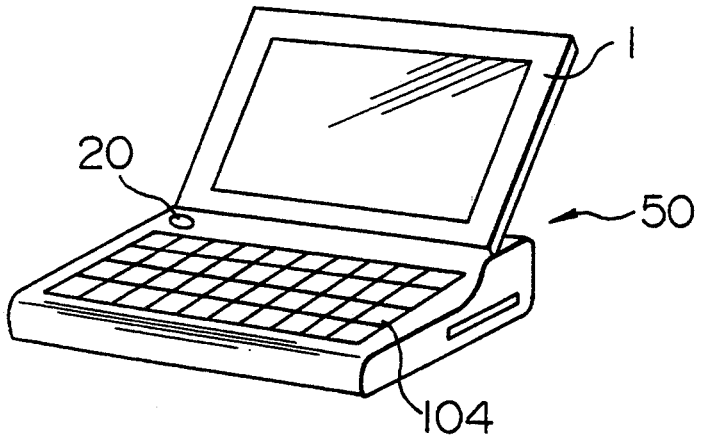

The display selection switch 20 may be provided in an information processing system 50 in a vicinity of the screen of the display 1 as shown in FIG. 10A or in a vicinity of a keyboard 104 as shown in FIG. 10B.

In the present embodiment, the selection switch 20 produces a "0" signal in its ON state and a "1" signal in its OFF state. The "0" signal corresponds to the screen center display mode while the "1" signal corresponds to the incremental pixel supplement display mode. When the operator desires to display in the screen center display mode, he/she turns on the display selection switch 20, and when he/she desires to display in the incremental pixel supplement display mode, he/she turns off the display selection switch 20.

When the display selection switch 20 is turned on, the "0" signal is applied to an address generator 15 of a display control LSI 100 so that the address generator 15 generates "40" as an offset value for the start of display so that the screen center display mode is selected, and stores it in an internal register 23. Thus, the display scan is started from the 40th line counted from the top of the screen.

Figure 4:
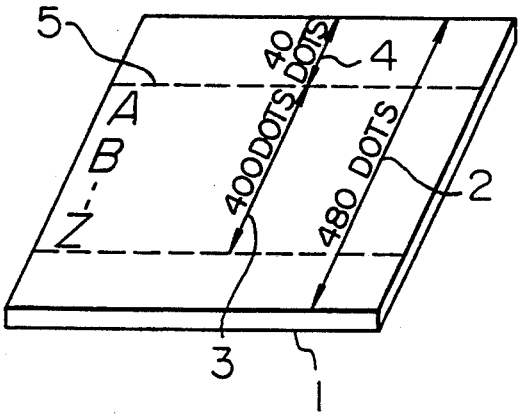
FIG. 4 shows a screen center display mode.

As a result, the screen center display as shown in FIG. 4 is made on the dot matrix display 1.

When the display selection switch 20 is turned off, the "1" signal is applied to the address generator 15 which generates the same address for two lines every five lines to attain the incremental pixel supplement display mode. Thus, the same display data is read from a display memory 101 every five lines.

Figure 5:
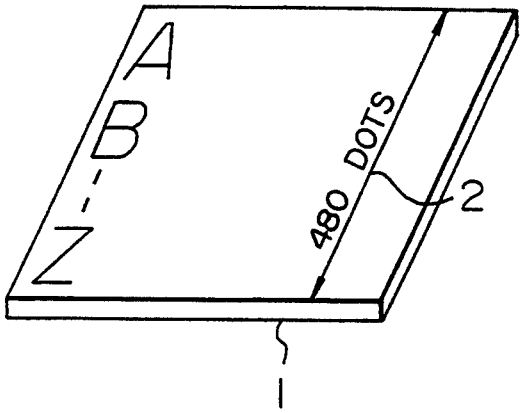
FIG. 5 shows an incremental pixel supplement display mode.

As a result, the same display data is sent for two lines to the dot matrix display from a data converter 14 every five lines and the data is displayed in the incremental pixel supplement display mode as shown in FIG. 5. The address generator 15 is connected to the CPU 105 through a bus 106 and the CPU can write into and read from the register 23 of the address generator 15.

Since the command to designate the display mode is directly applied to the display control LSI from the display selection switch 20, it is no longer necessary to interrupt the CPU as is done in the prior art system and the operator may freely switch the display mode at any time even during the execution of the application software by the CPU.

Alternatively, the incremental pixel supplement display mode may be selected when the display selection switch 20 is turned on, and the screen center display mode may be selected when it is turned off.

In the present embodiment, the ON and OFF states of the display selection switch 20 are associated with the two display modes, that is, the screen center display mode and the incremental pixel supplement display mode. Alternatively, signals "0", "1" . . . , "n" may be sequentially generated each time the display selection switch 20 is depressed and the display modes may be associated with those signals. In this case, the operator may select up to n display modes.

A plurality of switches or a counter may be used to select a plurality of display modes. Embodiments which use the counter are shown in FIGS. 1B and 1C. In FIG. 1B, a counter 60 is provided between the display selection switch 20 and the display control LSI 100. In FIG. 1C, the counter 60 is provided in the display control LSI 100.

Figure 2:
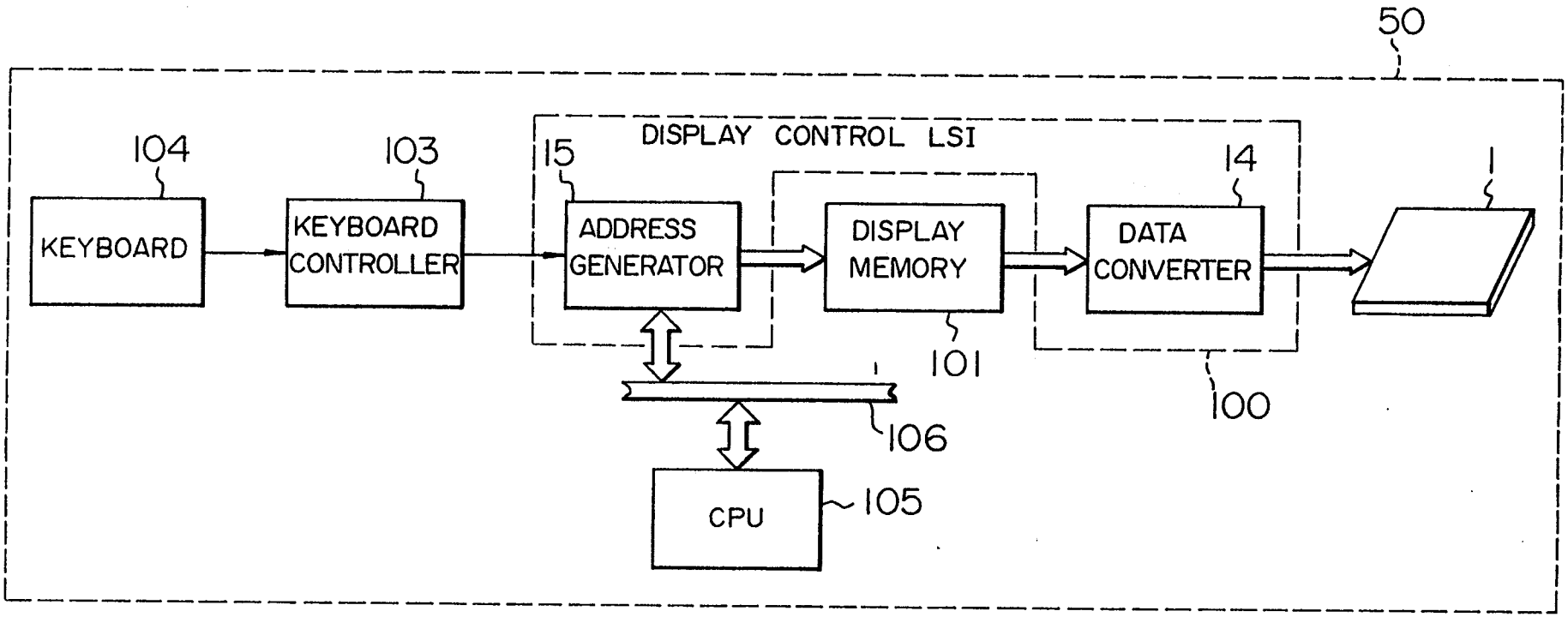
FIG. 2 shows a block diagram of another configuration of the embodiment.
Figure 3:
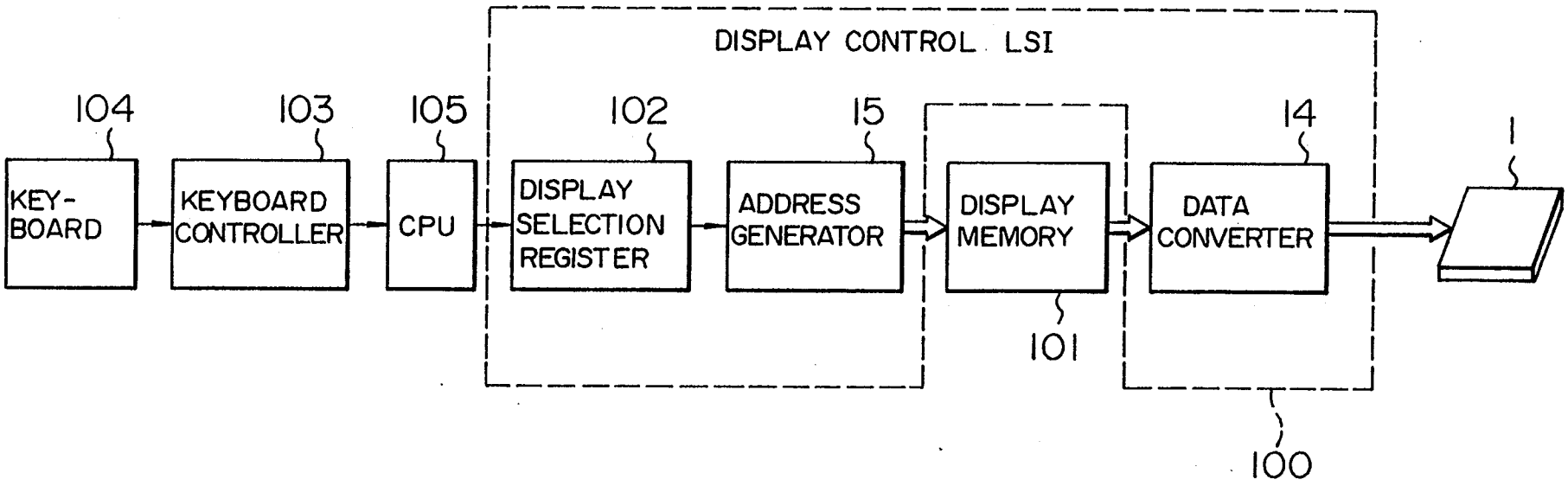
FIG. 3 PRIOR ART
FIG. 3 shows a block diagram of a configuration of a prior art system.

FIG. 2 shows a block diagram of another configuration of the present embodiment.

In the present embodiment, the information processing system uses a signal from a keyboard controller 103 instead of the signal from the display selection switch 20.

When a specified key of the keyboard 104 which is not used by the application software is depressed, the keyboard controller 103 generates a "1" signal, and when the specified key is depressed again, it generates a "0" signal. When the specified key is depressed further again, it generates the "1" signal. In this manner, each time the specified key is depressed, the keyboard controller 103 alternately generates the "1" and "0" signals. The "0" signal corresponds to the screen center display mode while the "1" signal corresponds to the incremental pixel supplement display mode. The output from the keyboard controller 103 may be a pulse signal which assumes "1" or "0" state for a predetermined duration.

By replacing the output of the display selection switch 20 of FIG. 1 by the output of the keyboard controller 103, the operator may select a plurality of display modes by depressing the specified key, as he/she can do in the embodiment of FIG. 1.

This output of the keyboard controller 103 is different from that applied to the CPU such as a character code output from an entry key. Accordingly, the control of the specified key by the keyboard controller 103 is completely independent from the control of the application software and the interruption of the CPU required in the prior art system is not necessary. Accordingly, the operator may freely switch the display mode at any time even during the execution of any application software.

The keyboard controller 103 may generate "0", "1", . . . , "n" signal sequentially each time the specified key is depressed and the display modes may be associated with the respective signals as they are in FIGS. 1B and 1C. In this case, the operator may select up to n display modes.

Alternatively, a plurality of specified keys may be used to switch a plurality of display modes.

In the two embodiments described above, the display mode is designated by the display selection switch 20 or the keyboard controller 103, although other types of switch, or transistor or IC which can generate selection signals may be used.

In the present embodiment, when a representation of a smaller vertical number of pixels than a vertical number of pixels of the display is to be displayed, the operator may freely switch the display mode even during the execution of any application software.

The present embodiment is applicable to a display of a large fixed number of pixels when it is to be used to display a representation of a small number of pixels required by the existing application software as well as to a display of a large number of pixels which may be developed in future.

A detail of the address generator 15 of the display control LSI 100 is now explained with reference to the drawings.

Figure 6:
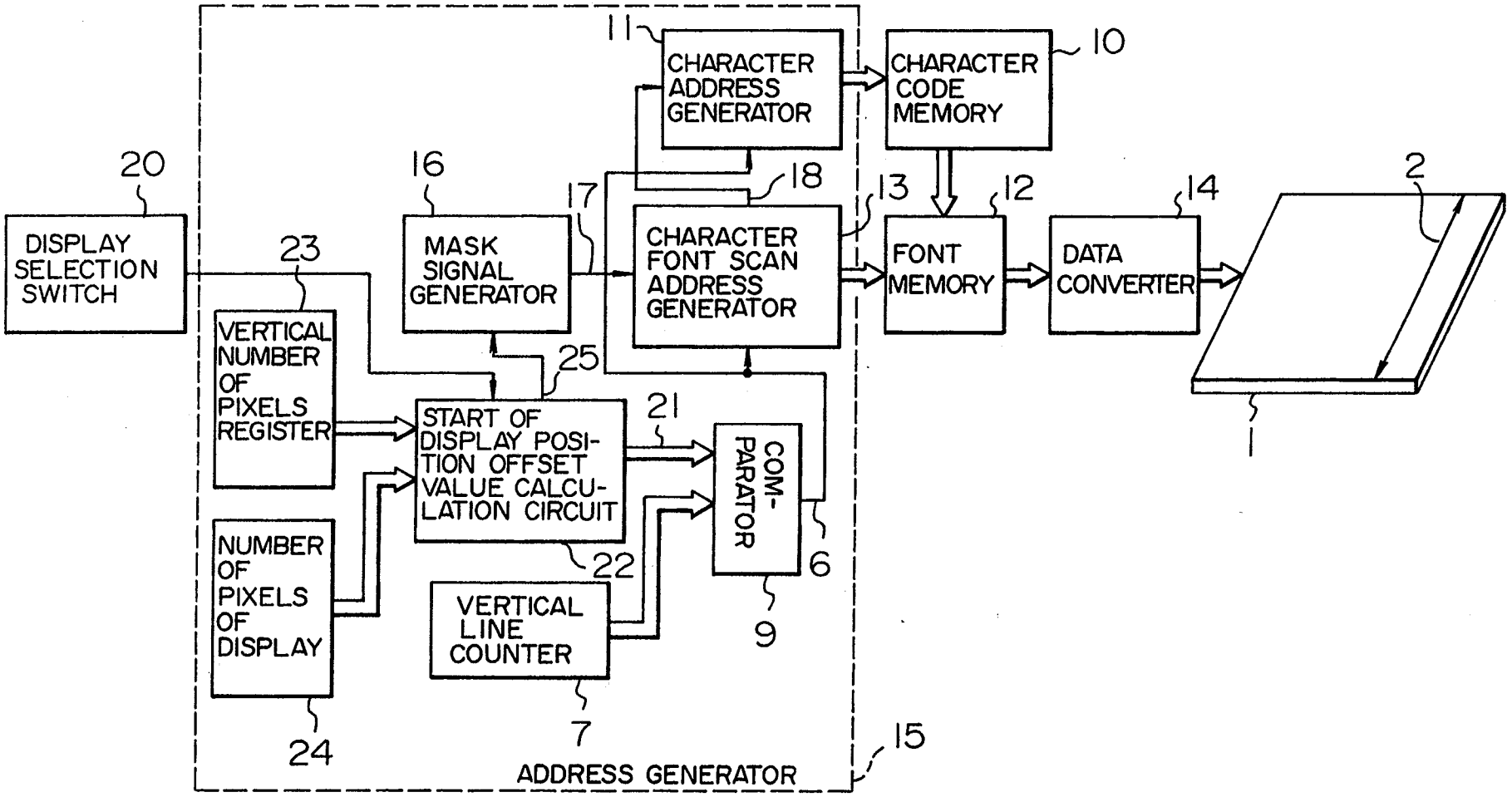
FIG. 6 shows a block diagram of a configuration of an address generator.

FIG. 6 shows a block diagram of a first configuration of the address generator 15.

Numeral 10 denotes a character code memory which stores characters to be displayed on the dot matrix display 1 in the form of character code and numeral 12 denotes a font memory which stores a character font in the form of dot image. In the present embodiment, the display memory 101 of FIG. 2 comprises two memories, the character code memory 10 and the font memory 12.

The address generator 15 of FIG. 2 comprises a character address generator 11 which generates two addresses, a character code address to be used when a character code is read and a character scan address indicating the number of vertical scans of the character font to be used when a character font is read, and a character font scan address generator 13 which generates a character font scan address.

Numeral 6 denotes an address clear line for clearing the character code address and the character font scan address at a start of display position, numeral 7 denotes a vertical line counter which sets "0" to a horizontal line at the top of the dot matrix display 1 and is incremented by each line of the dot matrix display, numeral 22 denotes a start of display position offset value calculation circuit which calculates an offset value of the start of display position, numeral 21 denotes an output line of the start of display position offset value calculation circuit 22, numerals 23 and 24 denote numbers of pixels of a vertical pixel count register and the display, respectively, which are parameters for the start of display position offset value calculation circuit 22, and numeral 9 denotes a comparator which compares the content of the vertical line counter 7 and the content of the output line 21 of the start of display position offset value calculation circuit 22 and produces a clear signal on the address clear line 6 when they match.

Numeral 16 denotes a mask signal generator to make the increment of the character font scan address generator 13 once every five lines in order to supplement the incremental pixels by continuously displaying the same information.

Numeral 17 denotes a mask signal line, numeral 18 denotes a character address vertical counter clock line, and numeral 25 denotes a mask signal enable signal line which permits or inhibits the generation of the mask signal by the mask signal generator 16.

In the present embodiment, it is assumed that the vertical number 2 of pixels of the dot matrix display 1 is 480 dots, and the vertical numbers of pixels as viewed from the application softwares include two cases, that is, 400 dots and 480 dots. When the vertical number of pixels as viewed from the application software is 400 dots, the information is displayed in one of the screen center display mode and the incremental pixel supplement display mode.

In the present embodiment, when the "0" signal is produced on the output line of the display selection switch 20, the screen center display mode is selected, and when the "1" signal is produced, the incremental pixel supplement display mode is selected.

In FIG. 6, the number 24 of pixels of the display is "480" as the vertical number of pixels of the dot matrix display 1, and "(the vertical number of pixels as viewed from the application software) − 1" is set in the vertical pixel count register 23. Namely, when the vertical number of pixels as viewed from the application software is 400 dots, "399" is set, and when it is 480 dots, "479" is set. It is set by the CPU before the display processing.

The start of display position offset value calculation circuit 22 calculates the start of display position offset value in the following manner based on the content of the number 24 of pixels of the dot matrix display and the content of the vertical display line register 23.

When "480" is set as the number 24 of pixels of the dot matrix display (the vertical number of pixels of the dot matrix display 1 is 480 dots) and the content of the vertical display line register 23 is "399" (the vertical number of pixels as viewed from the application software is 400 dots) and the output of the display selection switch 20 is "0" (to display in the screen center display mode), the start of display position offset value calculation circuit 22 produces a "0" signal on the mask signal enable signal line 25 and produces "40" on the output line 21 of the start of display position offset value calculation circuit 22.

When the content of the vertical display line register 23 is "399" (the vertical number of pixels as viewed from the application software is 400 dots) and the output of the display selection switch 20 is "1" (to display in the incremental pixel supplement display mode), the circuit 22 produces the "1" signal on the mask signal enable signal line 25 and the "0" signal on the output line 21 of the circuit 22.

When the content of the vertical display line register 23 is "479" (the vertical number of pixels as viewed from the application software is 480 dots), the circuit 22 produces the "0" signal on the mask signal enable signal line 25 and the "0" signal on the output line 21 of the circuit 22.

The operation when the vertical number of pixels as viewed from the application software is 480 dots is first explained.

As described above, the "0" signal is produced on the output line 21 of the start of display position offset value calculation circuit 22, and the "0" signal is produced on the mask signal enable signal line 25.

As a result, a signal which is "1" at the top of the screen is produced on the address clear line 6 by the signal on the output line 21, and the mask for the increment of the character font scan address generator 13 is inhibited by the signal on the signal line 25.

Thus, the 480 dots which are the vertical number of pixels as viewed from the application software are displayed as they are on the dot matrix display 1 having the vertical number of pixels of 480 dots.

The operation when the vertical number of pixels as viewed from the application software is 400 dots is now explained.

When the output of the display selection switch 20 is "0", "40" is produced on the output line 21 of the start of display offset value calculation circuit 22 and "0" is produced on the mask signal enable signal line 25, as described above.

Thus, a signal which is "1" at the 41st line from the top of the screen (when the content of the counter 7 is "40") is produced on the address clear line 6 by the signal on the output line 21, and the mask for the increment of the character font scan address generator 13 is inhibited by the signal on the signal line 25.

As a result, the representation of 400 dots with 40-dot upper and lower vacant areas, that is, the screen center display is attained on the dot matrix display 1 having the vertical number of pixels of 480 dots, as shown in FIG. 4.

When the output of the display selection switch 20 is "1", "0" is produced on the output line 21 of the start of display offset value calculation circuit 22 and "1" is produced on the mask signal enable signal line 25, as described above.

Thus, a signal which is "1" at the top of the screen is produced on the address clear line 6 by the signal on the output line 21, and the mask for the increment of the character font scan address generator 13 is permitted by the signal on the signal line 25.

The mask is explained in detail below.

Figure 7A:
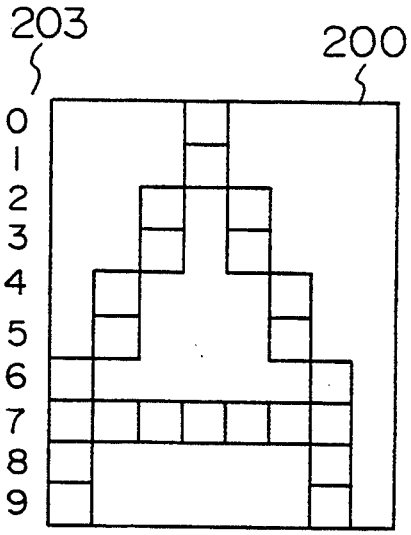
FIGS. 7A and 7B show count-up masks of a character font scan address.
Figure 7B:
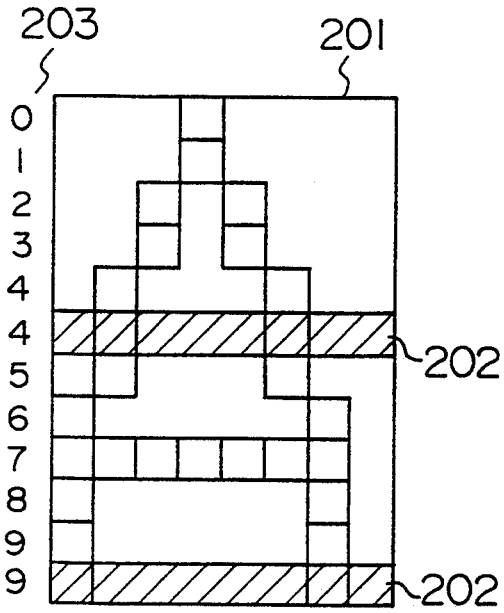

FIGS. 7A and 7B show examples of count-up mask for the character font scan address.

Numerals 200 and 201 denote representations before (FIG. 7A) and after (FIG. 7B) the masking of increment of the character font scan address, numeral 203 denotes a character font scan address, and numeral 202 denotes the same representation as that of a previous line attained by masking the increment.

In FIG. 6, when the mask signal generator 16 receives the "1" signal from the mask signal enable signal line 25, it generates a mask signal every five lines and supplies it to the mask signal line 17. In response to the mask signal, the character font scan address generator 13 masks the increment of the character font scan address every five lines.

As a result, the character font scan address 203 generates "4" and "9" twice, respectively, as shown by the representation 201 after the masking of increment so that the same representation 202 as that of the previous line is displayed.

In this manner, when the vertical number of pixels as viewed from the application software is 400 dots, the enlarged display to the entire display area of the dot matrix display 1 of 480 dots which is 6/5 times as large as 400 dots, that is, the incremental pixel supplement display mode is attained.

In the present embodiment, the text display of character-by-character type is described although the present invention is also applicable to the graphic display of the bit map image. An embodiment thereof is explained below.

Figure 8:
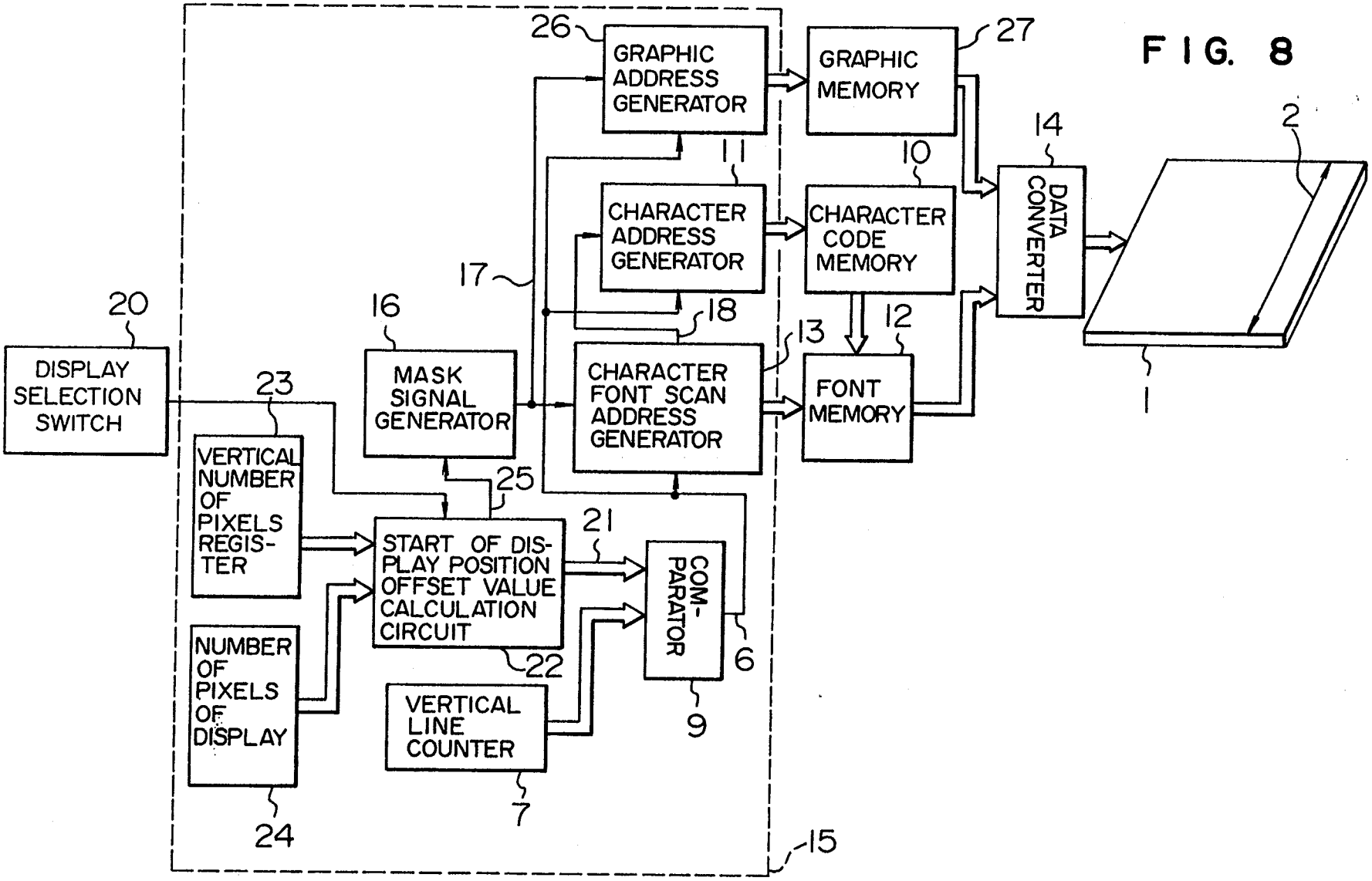
FIG. 8 shows a block diagram of another configuration of the address generator.

FIG. 8 shows a block diagram of another configuration of the address generator 15.

Numeral 10 denotes a character code memory which stores characters to be displayed on the dot matrix display 1 in the form of character code, numeral 12 denotes a font memory which stores a character font in the form of dot image, and numeral 26 denotes a graphic memory which stores graphic data to be stored on the dot matrix display 1 in the form of bit map image. In the present embodiment, the display memory 101 in FIG. 2 comprises three memories, the character code memory 10, the font memory 12 and the graphic memory 26.

The address generator 15 of FIG. 2 comprises a character address generator 11 which generates three addresses, that is, a character code address to be used when a character code is read, a character scan address indicating the number of vertical scans of the character font to be used when the character font is read, and a graphic data address to be used when the graphic data is read, a character font scan address generator 13 which generates a character font scan address, and a graphic address generator 27 which generates a graphic data address.

Numeral 6 denotes an address clear line which clears the character code address, the character font scan address and the graphic data address at the start of display position, numeral 7 denotes a vertical line counter which sets "0" to a horizontal scan line at the top of the dot matrix display 1 and is incremented by each line of the dot matrix display 1, numeral 22 denotes a start of display position offset value calculation circuit which calculates an offset value for the start of display position, numeral 21 denotes an output line of the start of display position offset value calculation circuit 22, numerals 23 and 24 denote numbers of pixels of a vertical pixel register and the display, respectively, which are parameters of the start of display position offset value calculation circuit 22, and numeral 9 denotes a comparator which compares the content of the vertical line counter 7 with the content of the output line 21 of the start of display position offset value calculation circuit 22 and produces a clear signal on the address clear line 6 when they match.

Numeral 16 denotes a mask signal generator which masks the increment of the character font scan address generator 13 and the graphic address generator 27 every five lines to continuously display the same information in order to supplement the incremental pixels.

Numeral 17 denotes a mask signal line, numeral 18 denotes a character address vertical counter clock line and numeral 25 denotes a mask signal enable signal line which permits or inhibits the generation of the mask signal by the mask signal generator 16.

In the present embodiment, it is assumed that the vertical number 2 of pixels of the dot matrix display 1 is 480 dots and the vertical numbers of pixels as viewed from the application software include two cases, that is, 400 dots and 480 dots. When the vertical number of pixels as viewed from the application software is 400 dots, the information is displayed in one of the screen center display mode and the incremental pixel supplement display mode.

In the present embodiment, when "0" is produced on the output line of the display selection switch 20, the screen center display mode is selected, and when "1" is produced, the incremental pixel supplement display mode is selected.

The start of display position offset value calculation circuit 22 of the present embodiment produces the start of display position offset value and the mask signal as it does in the above embodiment.

The graphic display of the bit map image is now explained.

When the vertical number of pixels as viewed from the application software is 480 dots, a signal which is "1" at the top of the screen is produced on the address clear line 6 and the masking of the increment for the graphic address generator 26 is inhibited.

As a result, 480 dots which is the vertical number of pixels as viewed from the application software are displayed as they are on the dot matrix display 1 having the vertical number of pixels of 480 dots.

When the vertical number of pixels as viewed from the application software is 400 dots and the output of the display selection switch 20 is "0", a signal which is "1" at the 41st line from the top of the screen is produced on the address clear line 6 and the masking of the increment of the graphic address generator 26 is inhibited.

As a result, a representation of 400 dots with 40-dot upper and lower vacant areas, that is, the screen center display mode is attained on the dot matrix display having the vertical number of pixels of 480 dots.

When the output of the display selection switch 20 is "1", a signal which is "1" at the top of the screen is produced on the address clear line 6 and the masking of the increment of the graphic address generator 26 is permitted.

As a result, an enlarged representation to the entire display area, that is, the incremental pixel supplement display mode is attained on the dot matrix display 1 having the vertical number of pixels of 480 dots.

In the present embodiment, only the screen center display mode and the incremental pixel supplement display mode have been described although there are various other display modes which will be described below.

In the above embodiment, the same data is displayed every five lines in the incremental pixel supplement display mode. When the display data is character data, the same display data may be displayed every number of lines per character row. This display mode is classified into two display modes which are described below.

In a font for one character, a bottom dot line is usually not printed in order to reserve it for underscore. In a vertical rule font, however, the bottom dot line is used to connect the vertically adjacent rule fonts.

Thus, the display data may be repeatedly displayed at each bottom dot line so that the vertical rule is displayed continuously while the characters are displayed with row-to-row space.

Figure 9:
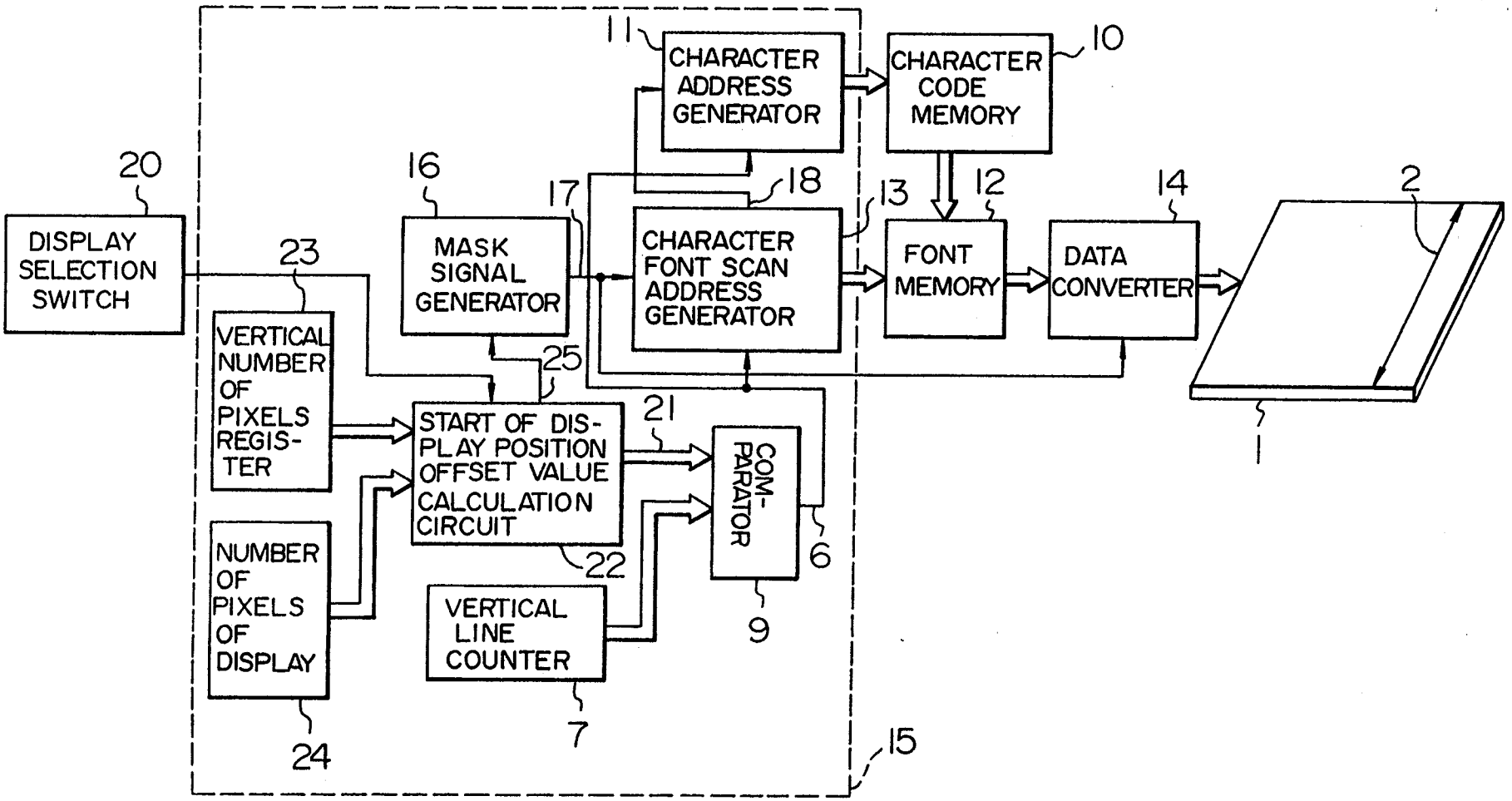
FIG. 9 shows a block diagram of other configuration of the address generator.

The mask signal enable signal line 17 of the mask signal generator 16 may be extended to the data converter 14 as shown in FIG. 9 so that the data converter 14 does not supply the same display data to the dot matrix display 1 when the mask signal is "0" but supplies it when the mask signal is "1". In this case, both character and vertical rule can be displayed with row-to-row space.

While the information is displayed at the center of the screen in the screen center display mode, it may be displayed at the top or bottom of the screen by changing the start of display position offset value.

Before the display process, a desired start of display position may be designated by a cursor or numeral and it may be stored in a register. The value stored in the register may then be read as the start of display position offset value to display the information at the desired position.

In the display mode other than the incremental pixel supplement display mode, blank areas appear on the screen. Since the addresses of those areas can be determined from the start of display position offset value, some patterns may be displayed in those blank areas.

The counter shown in FIG. 1B or 1C has a register to store the count although the content of the register may be written or read by the CPU which executes the application software.

Figure 11:
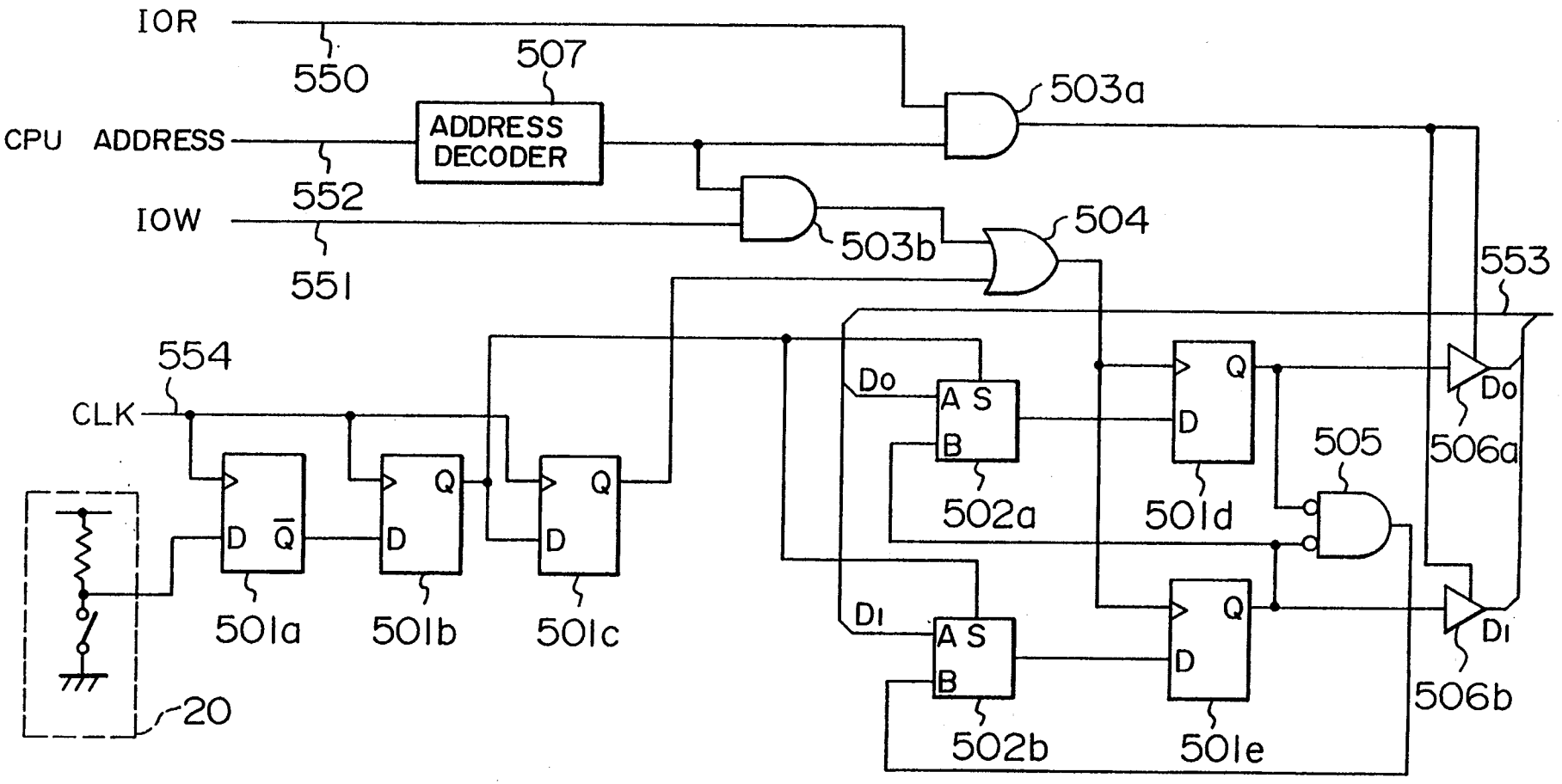
FIG. 11 shows a block diagram of another configuration of the present invention.

An embodiment which permits the selection of up to three display modes is explained with reference to FIG. 11. Numeral 20 denotes the display selection switch described in the above embodiment, numeral 501 denotes a D-type flip-flop, numeral 502 denotes a selector, numeral 503 denotes an AND gate, numeral 504 denotes an OR gate, numeral 505 denotes a NOR gate, numeral 506 denotes a three-state buffer, numeral 507 denotes an address decoder, numeral 550 denotes an IO read command of the CPU, numeral 551 denotes an IO write command of the CPU, numeral 552 denotes a CPU address and numeral 553 denotes a CPU data bus.

Figure 12:
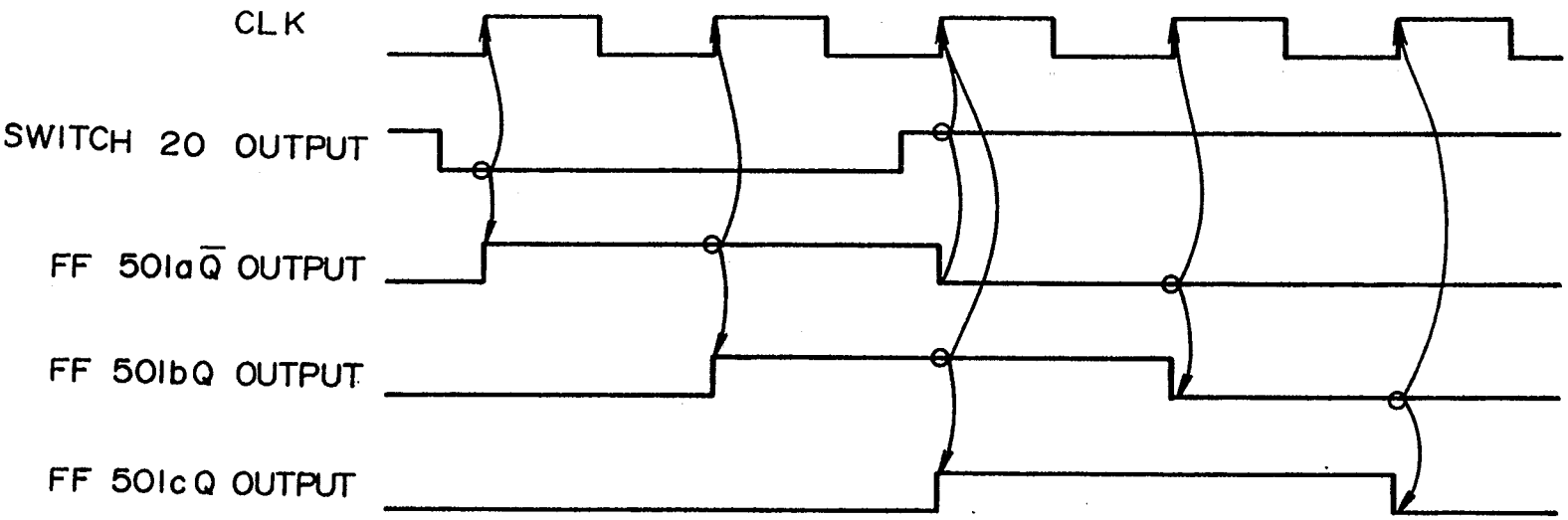
FIG. 12 shows waveforms at major parts of the circuit shown in FIG. 11.

An output waveform from the switch 20 is shifted by the flip-flops 501*a*, 501*b* and 501*c* as shown in FIG. 12. A Q-output of the flip-flop 501*c* is applied to clock inputs of the flip-flops 501*d* and 501*e* through the OR gate 504. On the other hand, a Q-output of the flip-flop 501*b* is applied to select terminals of the selectors 502*a* and 502*b*. When the selector terminal is at "Low", the selector 502 selects an A-input and when the select terminal is at "High", it selects a B-input. When a Q-output of the flip-flop 501*c* rises, the clocks of the flip-flops 501*d* and 501*e* rise as described above so that data is written. At this time, the Q-output of the flip-flop 501*b*, that is, the select terminals of the selectors 502*a* and 502*b* are "High" as shown in FIG. 12. Accordingly, an output of a NOR gate 505 which receives the Q-outputs of the flip-flops 501*d* and 501*e* is used as an input data to the flip-flop 501*e*, and the Q-output of the flip-flop 501*e* is used as an input data to the flip-flop 501*d*. As a result, each time the switch 20 is manipulated, the Q-output of the flip-flop 501*d* and the Q-output of the flip-flop 501*e* change to (0, 0), (0, 1), (1, 0), (0, 0),—. These outputs are used as display switching signals to switch among three display modes. In the present embodiment, the flip-flops 501*d* and 501*e* are designed to be read and written as the IO register of the CPU. When the CPU outputs an address allocated to the IO register, the output of the address register assumes "High". If an ID read command 550 of the CPU is now "High", the output of the AND gate 503*a* is also "High" and the three-state buffers 506*a* and 506*b* assume the output state to output the Q-outputs of the flip-flops 501*d* and 501*e* to the CPU data bus 553. Thus, the CPU can read the status of the flip-flops 501*d* and 501*e*. If the CPU outputs the address allocated to the IO address and the IO write command 551 is "High", the output of the AND gate 503*b* is "High" and the clocks of the flip-flops 501*d* and 501*e* are activated through the OR gate 504. If the switch 20 is not in the ON position, the selectors 502*a* and 502*b* select the A-inputs, that is, the CPU data bus 553 so that the content of the CPU data bus 553 is written into the flip-flops 501*d* and 501*e*.

We claim:

1. An information processing system including a display controller having a plurality of display modes for displaying display data having smaller vertical number of pixels than a vertical number of pixels of a display and having address generation means for generating read addresses for a display memory of the display data representing the display modes, comprising:

a single hardware switch means responsive to an operation by a user dedicated to generating a signal representing one of the display modes designed by the user and for outputting the signal directly to said display controller without passing through a CPU for executing an application program;

said address generation means generating a read address representing the display mode corresponding to said signal applied thereto.

2. An information processing system according to claim 1, wherein said signal generation means includes specific keys on a keyboard and a keyboard controller connected to said display controller.

3. An information processing system according to claim 1, wherein said display modes include at least two of:

a first display mode in which the number of pixels of display data having a smaller vertical number of pixels than a vertical number of pixels of the display is increased to the vertical number of pixels of the display when the display data is displayed;

a second display mode in which the display data having a smaller vertical number of pixels than the vertical number of pixels of the display is character data and the character data is displayed with an expanded line-to-line interval; and a third display mode in which the display data having a smaller vertical number of pixels than the vertical number of pixels of the display is displayed at a predetermined position on the display; and wherein said second display mode includes at least one of a mode for filling an expanded line with a blank line and a mode for filling the expanded line with a bottom line of a displayed character.

4. An information processing system according to claim 1, wherein the single hardware switch means is a single manual switch for generating one of a plurality of different outputs in accordance with a selected position thereof corresponding to the one display mode designated by the user.

5. A display controller in an information processing system having a plurality of display modes for displaying display data having a smaller vertical number of pixels than a vertical number of a display and including a single hardware switch means responsive to an operation by a user dedicated to generating a signal representing one of the display modes designated by the user, comprising:

address generation means for generating read address for a display memory of the display data representing the display modes; and signal receiving means for directly receiving the signal generated by said single hardware switch means without passing through a CPU for executing an application program;

said address generation means generating a read address representing the display mode corresponding to the receiving signal.

6. A display controller according to claim 5, wherein said signal generation means includes specific keys on a keyboard and a keyboard controller.

7. A display controller according to claim 5, wherein said display modes include at least two of:

a first display mode in which the number of pixels of display data having a smaller vertical number of pixels than a vertical number of pixels of the display is increased to the vertical number of pixels of the display when the display data is displayed;

a second display mode in which the display data having a smaller vertical number of pixels than the vertical number of pixels of the display is character data and the character data is displayed with an expanded line-to-line interval; and a third display mode in which the display data having a smaller vertical number of pixels than the vertical number of pixels of the display is displayed at a predetermined position on the display; and wherein said second display mode includes at least one of a mode for filling an expanded line with a blank line and a mode for filling the expanded line with a bottom line of a displayed character.

8. A display controller according to claim 5, wherein the single hardware switch means is a single manual switch for generating one of a plurality of different outputs in accordance with a selected position thereof corresponding to the one display mode designated by the user.

* * * * *